United States Patent [19]

Greve et al.

[11] 4,283,998

[45] Aug. 18, 1981

[54] METHOD AND MACHINE FOR MAKING A FILTER ROD

[75] Inventors: Heinz Greve, Hamburg; Gerhard Tolasch, Wentorf; Uwe Heitmann, Schwarzenbek; Günter Wahle, Reinbek, all of Fed. Rep. of Germany

[73] Assignee: Hauni-Werke Körber & Co. KG., Hamburg, Fed. Rep. of Germany

[21] Appl. No.: 25,042

[22] Filed: Mar. 29, 1979

[30] Foreign Application Priority Data

Apr. 7, 1978 [DE] Fed. Rep. of Germany ..... 2815025

[51] Int. Cl.[3] ..... A24C 5/56; A24D 3/02

[52] U.S. Cl. ..... 493/4; 156/64; 156/360

[58] Field of Search ..... 93/1 C, 77 FT; 156/64, 156/360

[56] References Cited

U.S. PATENT DOCUMENTS

| | | | |
|---|---|---|---|
| 3,399,606 | 9/1968 | Molins | 93/1 C |
| 3,865,016 | 2/1975 | Greve | 93/1 C |

*Primary Examiner*—Robert D. Baldwin

*Attorney, Agent, or Firm*—Peter K. Kontler

[57] ABSTRACT

The mass of successive increments of a wrapped rod-like filler of filamentary filter material is monitored by a beta ray detector and the signals which are generated by the ionization chamber of the dectector are utilized to adjust the ratio of a variable-speed transmission which regulates the rate of delivery of a stretched tow of filamentary material to the gathering horn of a filter rod making machine.

14 Claims, 2 Drawing Figures

METHOD AND MACHINE FOR MAKING A FILTER ROD

BACKGROUND OF THE INVENTION

The invention relates to the manufacture of filter rods in general, and more particularly to improvements in a method and machine for making filter rod sections which can be used as or converted into mouthpieces for filter cigarettes, cigars or cigarillos. Still more particularly, the invention relates to improvements in a method and machine for making filter rod sections whose fillers consist of cellulose acetate or another suitable filamentary filter material.

A machine for the making of filter rod sections whose fillers consist of or contain filamentary filter material comprises a system of transporting rolls which draw a filamentary tow from a bale and stretch the tow during transport past a device which sprays droplets of liquid plasticizer (such as triacetin) against successive increments of the stretched (and preferably banded) tow. The tow is thereupon converted into a rod-like filler which is draped into a web of cigarette paper or other suitable wrapping material. The resulting rod is severed at regular intervals to yield a succession of discrete filter rod sections of desired length (e.g., six times unit length).

A drawback of many presently known filter rod making machines is that the quantity of filter material varies from section to section. Such fluctuations are due to the fact that the tow is not uniform, i.e., the width and/or density of the tow often varies from unit length to unit length or at irregular intervals. The density varies because the filaments of the tow are crimped and the crimp is not uniform. When a tow consisting of unequally crimped filaments is flattened or expanded (such operation is called banding) and is thereupon stretched during travel between transporting rolls which are driven at different peripheral speeds, the resulting spread out tow or layer often or invariably includes portions of greater and lesser density.

U.S. Pat. No. 3,399,606 to Molins discloses a filter rod making machine wherein the mass of the rod-like filler of filamentary filter material is monitored and the stretching or tensioning action of transporting rolls is changed when the monitored mass deviates from a desired value. Changing the tensioning action upon the filaments of the tow creates other problems, especially as concerns the predictability of treatments which follow the stretching step. Such treatments include the aforediscussed application of droplets of liquid plasticizer. Each change of the stretching action results in deviation of the quantity of plasticizer which is applied per unit length of the tow from a desired or optimum value.

OBJECTS AND SUMMARY OF THE INVENTION

An object of the invention is to provide a novel and improved method which can be resorted to for the making of high-quality filter rod sections wherein the fillers consist of filamentary material.

Another object of the invention is to provide a method which insures that eventual deviations of the mass of filamentary filter material in filter rod sections from a desired value can be eliminated or greatly reduced with a minimum of delay.

A further object of the invention is to provide a method which insures that the number of successively produced filter rod sections wherein the mass of filamentary material deviates from an optimum value is negligible.

An additional object of the invention is to provide a filter rod making machine with novel and improved means for detecting filter rod sections containing unsatisfactory fillers and for rapidly eliminating the cause or causes of such defects.

Another object of the invention is to provide novel and improved means for adjusting the operation of a filter rod making machine, especially the operation of devices which treat the running tow upstream of the wrapping station, upon detection of filter rod sections wherein the mass of filamentary filter material is excessive or below an acceptable value.

One feature of the invention resides in the provision of a method of making a homogeneous wrapped rod-like filler. The method comprises the steps of conveying an elongated tow of crimped filamentary filter material (wherein the filaments are movable or shiftable with respect to each other) lengthwise along an elongated path, stretching the tow lengthwise in a first portion of the path, converting the stretched tow into a rod-like filler in a second portion of the path, draping the rod-like filler into a web of wrapping material in a third portion of the path, measuring the mass of successive increments of the wrapped filler and generating signals each having a characteristic denoting the measured mass of such increments, and utilizing the signals to change the rate of transport of the tow from the first to the second portion of the path when the characteristic of the signals deviates from a predetermined value.

The measuring step may comprise directing a beam of corpuscular radiation across the wrapped filler and ascertaining the amount of radiation which penetrates through successive increments of the wrapped filler. For example, the beam may consist of beta rays.

The utilizing step may comprise converting the aforementioned signals into second signals denoting the deviation of the mass of several successive increments of the wrapped filler from the predetermined value and changing the rate of transport of the tow from the first into the second portion of the path as a function of the characteristics of the second signals. The changing step may include respectively increasing and reducing the rate of transport of the tow into the second portion of the path when the second signals respectively denote a more and less pronounced deviation of the mass of several successive increments of the wrapped filler from the predetermined value.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
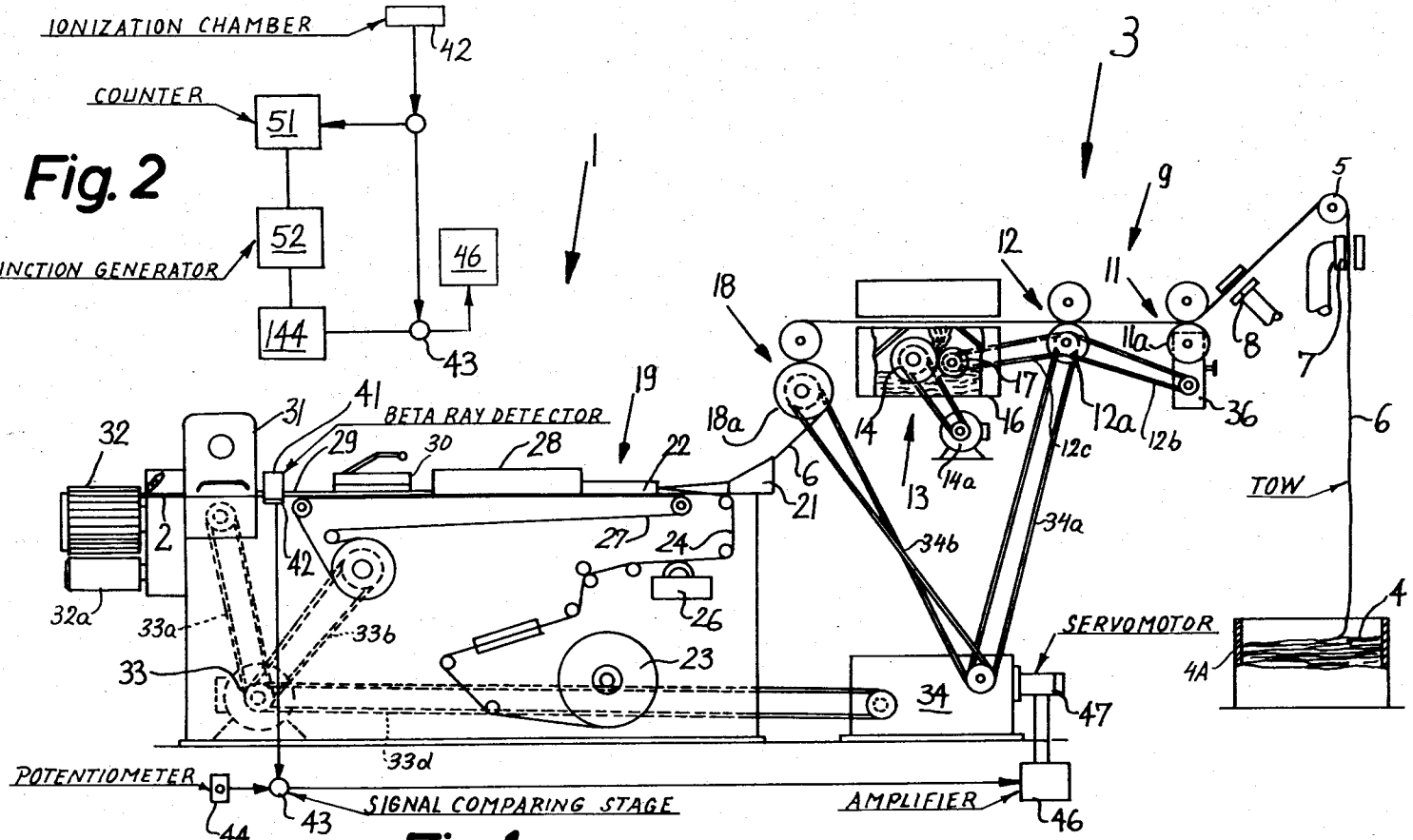
FIG. 1 is a schematic partly elevational, partly diagrammatic and partly sectional view of a filter rod making machine which embodies one form of the invention.
FIG. 2 is a diagrammatic view of a portion of a modified filter rod making machine.

FIG. 1 shows a filter rod making machine which produces filter rod sections 2 of desired length (e.g., six times unit length). The machine comprises a tow processing unit 3 and a filter rod making unit 1. The tow 6 is withdrawn from a bale 4 which is stored in a receptacle 4A and is caused to pass over a guide roller 5 on its way toward the nip of a first pair of driven advancing or transporting rolls 11. During travel toward the guide roller 5, successive increments of the tow 6 advance through a first banding device 7 which spreads out the tow so that the tow resembles a relatively flat and wide layer before it reaches the rolls 11. A second banding device 8 is installed between the guide roller 5 and the advancing rolls 11. The exact mode of operation of the banding devices 7 and 8 forms no part of the invention. As a rule, each of these banding devices comprises a plenum chamber which discharges a single stream or discrete streams of compressed gaseous fluid against one side of the running tow and a barrier opposite the outlet or outlets of the plenum chamber. The stream or streams of compressed fluid uniformize the distribution of filaments (e.g., acetate fibers) in the tow and increase the width of the tow. Such banding is desirable when the tow is to be sprayed with droplets of liquid plasticizer. The stream or streams issuing from the plenum chamber of each banding device can increase the width of the tow because the filaments of the tow are movable relative to each other.

The advancing rolls 11 form part of a stretching or elongating device 9 wherein the filaments of the tow 6 are subjected to tensional stresses so that the crimp of the filamentary material is reduced or eliminated before the thus tensioned filaments enter the station 13 for the application of liquid plasticizer. The stretching device 9 further comprises a second pair of driven advancing or transporting rolls 12 whose peripheral speed exceeds the peripheral speed of the rolls 11 and which are located downstream of the rolls 11, as considered in the direction of transport of the tow 6 toward the station 13.

The lower roll 12*a* of the downstream pair of advancing rolls 12 is driven by a belt or chain 34*a* which derives motion from the output element of a variable-speed transmission 34. The lower roll 11*a* of the upstream pair of advancing rolls 11 is driven by the output element of a second variable-speed transmission 36 whose input element is driven by a belt or chain 12*b* deriving motion from the lower roll 12*a*. The difference between the peripheral speeds of the rolls 11 and 12 suffices to subject the filaments of the tow 6 to a tensioning action which insures adequate distribution of droplets of liquid plasticizer (e.g., triacetin) at the station 13. The device which applies atomized plasticizer comprises a vessel 16 for a supply of liquid plasticizer, a withdrawing roller 14 which dips into the supply of plasticizer in the vessel 16 and draws a film of plasticizer into the range of a rotary spraying member 17 (e.g., a brush) which propels droplets of plasticizer against the underside of the running tow 6. The spraying member 17 is driven by a belt or chain 12*c* which derives motion from the roll 12*a*, and the withdrawing roller 14 is driven by a prime mover 14*a*.

The tow 6 whose filaments are provided with liquid plasticizer advances toward and into the nip of two further advancing or transporting rolls 18 whose peripheral speed is preferably somewhat less than the peripheral speed of the rolls 12. The lower roll 18*a* is driven by a belt or chain 34*b* which receives motion from the output element of the transmission 34. The rolls 18 advance the tow 6 toward a gathering horn 21 which converts the spread out tow into a continuous rod-like filler, and such filler enters a draping or wrapping mechanism 19 to be draped into a web 24 of suitable wrapping material, such as cigarette paper or imitation cork. The mechanism 19 comprises an endless belt conveyor 27 (known as garniture) which draws the web 24 from a bobbin 23. The web advances along a paster 26 which applies a film of adhesive to one side of the web. The garniture 27 draws the web 24 and the rod-like filler (converted tow 6) through a device 22 which forms part of the wrapping mechanism 19 and folds the web 24 around the filler so that the overlapping marginal portions of the resulting tubular wrapper adhere to each other. Such marginal portions form a seam which extends lengthwise of the filter rod 29. The formation of the seam is completed in a device 28 which also forms part of the mechanism 19, and the rod 29 thereupon advances along a sealer 30 which heats or cools the seam (depending upon whether the adhesive in the paster 26 is a wet adhesive or a hotmelt). The rod 29 is severed by a conventional cutoff 31 which subdivides the rod into a file of discrete filter rod sections 2. Such sections are propelled into the flutes of a rotary drum-shaped row forming conveyor 32 which converts the single file into one or more rows wherein the sections 2 move sideways. The thus obtained row or rows of sections 2 are delivered onto the upper reach of a belt conveyor 32*a* which transports them into trays, into the magazine of a filter tipping machine, or to a pneumatic sender serving to propel the sections to one or more remote filler tipping machines, e.g., to machines known as MAX or MAX S produced by the assignee of the present application.

The filter rod making machine further comprises a main prime mover 33 (e.g., a variable-speed electric motor) which transmits motion to the knife or knives of the cutoff 31 via belt or chain 33*a*, to the garniture 27 via belt or chain 33*b* and to the input element of the transmission 34 via belt or chain 33*d*. The transmission 34 is a variable-speed transmission whose output element transmits motion to the aforementioned belts or chains 34*a* and 34*b*, i.e., to the advancing rolls 11*a*, 12*a*, 18*a* and to the spraying member 17 of the plasticizer applying device at the station 13. The transmission 36 is adjustable to change the ratio of peripheral speeds of the rolls 11 and 12, i.e., to regulate the tensioning action upon filaments which travel through the stretching device 9.

The just described machine operates quite satisfactorily, even if the crimp of filaments in the bale 4 is not uniform. However, long-range (prolonged) deviations of the mass of unit lengths of the tow 6 from an optimum value are likely to affect the quality of filter rod sections 2. Since the manufacturers of filter tipped cigarettes, cigars and cigarillos demand that the quality of filter rod sections match an optimum value, especially that the resistance which each and every filter rod section 2 offers to axial flow of a gas through its wrapper match or very closely approximate an optimum resistance, the machine of FIG. 1 is equipped with means for eliminating deviations of the mass of unit lengths of the rod-like filler from a preselected value.

In accordance with the invention, the machine is equipped with a monitoring or measuring device 41 which includes a source of corpuscular radiation (preferably beta rays) and a transducer 42 which is located opposite the source and is exposed to radiation which penetrates through successive increments of the filter rod 29. The transducer 42 may constitute an ionization chamber whose output transmits signals denoting the intensity of radiation which penetrates through the rod 29. Thus, the signals which the output of the ionization chamber 42 transmits are indicative of the mass of filter material (filaments) per unit length of the rod 29. The output of the chamber 42 is connected with one input of a signal comparing stage 43 another input of which receives a reference signal from a suitable source 44 (e.g., an adjustable potentiometer). The output of the stage 43 transmits a signal when the intensity or another characteristic of the signal transmitted by the chamber 42 deviates from the corresponding characteristic of the reference signal which is furnished by the source 44. Such output signal is transmitted to the input of an amplifier 46 which controls a servomotor 47 constituting a means for adjusting the ratio of the transmission 34. The adjustment is such that long-range deviations of the mass of filter material per unit length of the filter rod 29 are eliminated by changing the speed of the advancing rolls 11, 12, 18 and by simultaneously changing the rate of application of plasticizer in order to insure that the quantity of applied plasticizer per unit length of the tow 6 remains unchanged. The speed of the advancing rolls 18 is increased if the mass of filamentary material per unit length of the filter rod 29 is too low, and vice versa.

The resistance which the filter rod sections 2 offer to axial flow of a gas therethrough can be maintained at a fixed value primarily by insuring that the mass of filter material per unit length of the rod 29 remains constant. Additional regulating action can be achieved by employing banding means (devices 7 and 8) whose spreading action is uniform (such banding devices can be of the adjustable type) and/or by insuring that the quantity of applied plasticizer per section 2 remains constant.

The illustrated monitoring device 41 (which utilizes a source of beta rays) can be replaced with other types of means for monitoring the mass of filter material per unit length of the rod 29.

FIG. 2 illustrates a modification of the means for varying the ratio of transmission 34. The signal at the output of the signal comparing stage 43 is not indicative of the difference between the characteristics of signals from the chamber 42 and a fixed (unchanging) reference signal. Instead, the output signal which is transmitted by the stage 43 of FIG. 2 denotes the difference between a characteristic of the signal from the chamber 42 and a variable reference signal transmitted by a source 144. The reference signal is varied as a function of straying (deviation) of several successive signals at the output of the chamber 42 from an optimum value. The means for varying the output signal comprises a counter 51 whose input receives signals from the output of the chamber 42 and whose output transmits second signals to the input of the source 144 by way of a function generator 52. The purpose of the circuits 51 and 52 is to influence the source 144 so that the intensity of the reference signal which is transmitted to the left-hand input of the stage 43 increases when the extent to which the signal at the output of the transducer 42 exceeds the fixed value and vice versa. This insures that a constant number of sections 2 is located statistically outside of a predetermined range.

In many instances, only the mass of a certain percentage of filter rod sections is outside of a predetermined range. For example, only a certain small percentage of the total output of the machine is unsatisfactory. An indicator of the number of unsatisfactory sections in a group of sampled sections is the number of different classes (by weight) of sections in such group. In order to avoid excessive increases of the mass of tow 6 immediately ahead of the horn 21 in response to detection of minor deviation of the mass of a monitored increment of the filler 29 from a desired value, and also to avoid the production of an excessive number of unsatisfactory sections (whose mass is too low) in response to pronounced deviations of the monitored mass of an increment of the filler 29 from an optimum value, the circuit arrangement of FIG. 2 generates second signals which change the characteristics of the reference signal (by adjusting the source 144) in such a way that, when the deviation of a characteristic of several signals from the transducer (chamber 42) increases, the speed of the rolls 18 is changed to increase the rate of feed of tow 6 toward the gathering horn 21 and vice versa.

The circuit 51 ascertains the extent of deviation of several successive signals from the chamber 42 from a desired value, and the function generator 52 influences the intensity of the reference signal at the output of the source 144 as a function of the intensity or another characteristic of the (second) signal at the output of the circuit 51.

The monitoring or measuring device 41 can be located adjacent to the path of sections 2 between the cutoff 31 and the conveyor 32, i.e., the device 41 can monitor the mass of successive increments of a continuous wrapped rod-like filler (29) or the mass of successive discrete sections (2) of such filler.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. A method of making a wrapped homogeneous rod-like filler, comprising the steps of conveying an elongated tow of crimped filamentary filter material lengthwise along an elongated path; stretching the tow in a first portion of said path; converting the stretched tow into a rod-like filler in a second portion of said path; draping the filler into a web of wrapping material in a third portion of said path; measuring the mass of successive increments of the wrapped filler and generating signals each having a characteristic denoting the measured mass of such increments; and utilizing said signals to change the rate of transport of the tow to said second portion of said path, while maintaining the stretching action at an at least substantially constant value, when said characteristic of said signals deviates from a predetermined value.

2. The method of claim 1, wherein said measuring step comprises directing a beam of corpuscular radiation across the wrapped filler and ascertaining the amount of radiation which penetrates through successive increments of the wrapped filler.

3. The method of claim 2, wherein said beam consists of beta rays.

4. The method of claim 1, wherein said utilizing step comprises converting said signals into second signals denoting deviation of the mass of several successive increments of the wrapped filler from said predetermined value and changing the rate of transport of the tow into said second portion of said path as a function of the characteristics of said second signals.

5. The method of claim 4, wherein said changing step includes respectively increasing and reducing said rate when said second signals respectively denote a more and less pronounced deviation of the mass of several successive increments from said predetermined value.

6. A machine for making a homogeneous wrapped rod-like filler, comprising a source of a tow of crimped filamentary filter material; means for transporting the tow from said source along an elongated path, including means for stretching the tow in a first portion of said path; gathering means for converting the stretched tow into a rod-like filler in a second portion of said path; a source of web-like wrapping material; means for drawing the wrapping material from the respective source; means for draping the withdrawn wrapping material around the rod-like filler in a third portion of said path; and means for measuring the mass of successive increments of the wrapped filler in a fourth portion of said path, including means for generating signals each having a characteristic denoting the mass of the respective increment, said transporting means including means for varying the rate of transport of the tow to said gathering means as a function of deviation of the characteristics of said signals from a predetermined value which maintaining the action of said stretching means upon the tow in said first portion of said path at an at least substantially constant value.

7. The machine of claim 6, wherein said measuring means comprises means for directing a beam of corpuscular radiation across the wrapped filler in said fourth portion of said path, and transducer means located opposite said radiation directing means for generating electric signals whose intensity is a function of the amount of radiation penetrating through successive increments of the wrapped filler.

8. The machine of claim 7, wherein said beam consists of beta rays.

9. The machine of claim 6, wherein said means for varying the rate of transport comprises a pair of driven advancing rolls for the stretched tow, and means for changing the speed of said rolls as a function of deviations of the characteristics of said signals from said predetermined value.

10. The machine of claim 6, wherein said stretching means includes two pairs of spaced apart driven advancing rolls for the tow and further comprising means for varying the speed of at least one pair of said rolls.

11. The machine of claim 10, further comprising means for varying the ratio of peripheral speed of one of said pairs of rolls with respect to the peripheral speed of the other pair of said rolls.

12. The machine of claim 6, further comprising a source of liquid plasticizer, and means for drawing plasticizer from said last mentioned source and for spraying the withdrawn plasticizer onto the filamentary material of the stretched tow between said stretching means and said gathering means.

13. The machine of claim 6, further comprising at least one banding device for the tow, said banding device being disposed between said source of tow and said stretching means.

14. The machine of claim 6, further comprising means for converting said first signals into second signals denoting the deviation of the mass of several successive increments of the wrapped filler from said value, said means for varying the rate of transport including means for changing the speed of the tow upstream of said gathering means as a function of a characteristic of said second signals.

* * * * *